US007752970B2

(12) United States Patent
Nelson et al.

(10) Patent No.: US 7,752,970 B2
(45) Date of Patent: Jul. 13, 2010

(54) NETWORKED ELECTRONIC ORDNANCE SYSTEM

(75) Inventors: Steven D. Nelson, Redondo Beach, CA (US); Michael N. Diamond, Thousand Oaks, CA (US)

(73) Assignee: PS/EMC West, LLC, Chandler, AZ (US)

( * ) Notice: Subject to any disclaimer, the term of this patent is extended or adjusted under 35 U.S.C. 154(b) by 0 days.

(21) Appl. No.: 10/917,076

(22) Filed: Aug. 12, 2004

(65) Prior Publication Data

US 2009/0314175 A1 Dec. 24, 2009

Related U.S. Application Data

(63) Continuation-in-part of application No. 09/656,325, filed on Sep. 6, 2000, now Pat. No. 7,644,661.

(51) Int. Cl.
*F23Q 21/00* (2006.01)

(52) U.S. Cl. ..... 102/215

(58) Field of Classification Search ..... 102/202.1, 102/202.5, 202.6, 202.7, 202.8, 202.9, 202.12, 102/202.14, 206, 215, 217; 89/1.51, 1.59; 280/728.1–743.2

See application file for complete search history.

(56) References Cited

U.S. PATENT DOCUMENTS

| | | | | |
|---|---|---|---|---|
| 3,022,446 | A * | 2/1962 | Irish, Jr. | 361/248 |
| 3,255,366 | A * | 6/1966 | McNulty et al. | 307/106 |
| 3,421,400 | A | 1/1969 | Snyder | |
| 3,571,609 | A * | 3/1971 | Knudson | 307/106 |
| 3,672,303 | A * | 6/1972 | Brawn | |
| 4,157,069 | A * | 6/1979 | Gustafsson et al. | 102/200 |
| 4,674,047 | A * | 6/1987 | Tyler et al. | 89/28.05 |
| 4,869,171 | A | 9/1989 | Abouav | |

(Continued)

FOREIGN PATENT DOCUMENTS

| | | | |
|---|---|---|---|
| EP | 1186852 | * | 3/2002 |

(Continued)

OTHER PUBLICATIONS

Intelligent Initiation Systems, 2nd Annual Missiles & Rockets Symposium & Exhibition, Craig J. Boucher, May 14-16, 2001.*

(Continued)

*Primary Examiner*—Troy Chambers
(74) *Attorney, Agent, or Firm*—McAndrews, Held & Malloy, Ltd.

(57) ABSTRACT

A networked electronic ordnance system and method for controlling a variety of pyrotechnic devices at different energy levels include a bus controller controlling at least one pyrotechnic device operating at a first energy level and a smart connector adapting at least one pyrotechnic device operating at a second energy level to control by the bus controller. The smart connector may also include a plurality of capacitors for firing the pyrotechnic device(s). In an embodiment, at least one pyrotechnic device operating at a first energy level and at least one pyrotechnic device operating at a second level include a logic device have a unique identifier. The smart connector may also include an energy reserve capacitor and an emitter follower circuit electrically connected to a logic device. Additionally, the smart connector may be connected to an initiator for firing at least one pyrotechnic device at the second energy level.

18 Claims, 6 Drawing Sheets

U.S. PATENT DOCUMENTS

| | | | | |
|---|---|---|---|---|
| 4,986,183 | A | 1/1991 | Jacob et al. | |
| 5,014,622 | A | 5/1991 | Julian | |
| 5,034,686 | A * | 7/1991 | Aspelin | 324/537 |
| 5,036,465 | A | 7/1991 | Ackerman, Jr. et al. | |
| 5,090,321 | A | 2/1992 | Abouav | |
| 5,117,756 | A | 6/1992 | Goffin, II | |
| 5,206,455 | A | 4/1993 | Williams et al. | |
| 5,229,538 | A * | 7/1993 | McGlynn et al. | 89/1.56 |
| 5,282,421 | A | 2/1994 | Marsh et al. | |
| 5,284,094 | A | 2/1994 | La Mura et al. | |
| 5,295,438 | A | 3/1994 | Hill et al. | |
| 5,510,952 | A * | 4/1996 | Bonavia et al. | 361/251 |
| 5,520,114 | A | 5/1996 | Guimard et al. | |
| 5,520,115 | A | 5/1996 | Braun | |
| 5,533,454 | A | 7/1996 | Ellis et al. | |
| 5,554,817 | A | 9/1996 | La Mura et al. | |
| 5,563,366 | A | 10/1996 | La Mura et al. | |
| 5,587,550 | A | 12/1996 | Willis et al. | |
| 5,825,098 | A | 10/1998 | Darbey et al. | |
| 5,835,873 | A | 11/1998 | Darby et al. | |
| 6,070,531 | A | 6/2000 | Hansen et al. | |
| 6,082,264 | A | 7/2000 | Meyer et al. | |
| 6,085,659 | A | 7/2000 | Beukes | |
| 6,152,011 | A * | 11/2000 | Ivy et al. | 89/1.814 |
| 6,166,452 | A * | 12/2000 | Adams et al. | 307/10.1 |
| 6,173,651 | B1 | 1/2001 | Pathe et al. | |
| 6,191,949 | B1 | 2/2001 | Hansen et al. | |
| 6,227,115 | B1 | 5/2001 | Gruber et al. | |
| 6,275,756 | B1 | 8/2001 | Griggs et al. | |
| 6,283,227 | B1 | 9/2001 | Lerche et al. | |
| 6,300,764 | B1 | 10/2001 | Kelley | |
| 6,341,562 | B1 | 1/2002 | Brisighella | |
| 6,403,887 | B1 | 6/2002 | Kebabjian et al. | |
| 6,418,853 | B1 | 7/2002 | Duguet et al. | |
| 6,584,907 | B2 | 7/2003 | Boucher et al. | |
| 6,718,881 | B2 | 4/2004 | Rauscher | |
| 6,789,483 | B1 * | 9/2004 | Jennings et al. | 102/202.5 |
| 7,261,028 | B2 * | 8/2007 | Devries et al. | 89/1.1 |
| 2003/0056678 | A1 * | 3/2003 | Griggs et al. | 102/202.1 |
| 2003/0234527 | A1 * | 12/2003 | Okamoto et al. | 280/741 |
| 2004/0020394 | A1 * | 2/2004 | Boucher et al. | 102/217 |

FOREIGN PATENT DOCUMENTS

| | | | |
|---|---|---|---|
| WO | WO 01/42732 | A1 | 6/2001 |
| WO | WO 01/67031 | A1 | 9/2001 |

OTHER PUBLICATIONS

Ensign-Bickford Aerospace & Defense Company: WizOrd™ Intelligent Initiation System, publication date unknown.*

"Advanced Ordnance Initiation System Development for a Unique Set of Requirements", Barglowski, Michael J and Boucher, Craig J., 38th AIAA/ASME/SAE/ASEE Joint Propulsion Cofnerence & Exhibit, Jul. 7-10, 2002.*

Definition of translate, Merriam Webster online dictionary, www.merriam-webster.com.*

* cited by examiner

500

NETWORKED ELECTRONIC ORDNANCE SYSTEM

RELATED APPLICATIONS

This application is a continuation-in-part of U.S. patent application Ser. No. 09/656,325, filed on Sep. 6, 2000 now U.S Pat. No. 7,644,661, with inventors Michael Diamond and Steven Nelson, entitled "Networked Electronic Ordnance System."

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The field of this invention relates to a networked system of pyrotechnic devices.

Pyrotechnic devices play an increasingly important role in aerospace vehicles and systems such as rockets, aircraft and spacecraft. As an example, the number of pyrotechnic devices used on a typical missile has increased over the years from less than ten to as many as two hundred or more. The additional pyrotechnic devices may be used for several purposes. For example, multiple lower-powered initiators may be used in place of a single higher-powered initiator to provide flexibility in the amount of force that can be generated at a single location on the vehicle. However, the use of additional pyrotechnic devices carries with it the burden of additional infrastructure within the vehicle or system using these devices. As the number of pyrotechnic devices in a vehicle or system increases, several other things increase as well, such as cabling length, cable quantity, weight, number of parts, power usage, system complexity, manufacturing time and system cost. In an environment such as a rocket or missile, weight and volume are at a premium, and an increase in pyrotechnic system weight and volume presents packaging and weight management problems which may require significant engineering time to solve.

One source of these problems is cable size and weight. FIG. 1 shows a typical prior art installation of pyrotechnic initiators 100, where each pyrotechnic initiator 100 is connected to a fire control unit 102, which transmits firing energy to the pyrotechnic devices 100 when a signal to do so is received from a controller 104. Typically, these devices are connected in an inefficient branching configuration. That is, a separate cable 106 connects each pyrotechnic device 100 individually to a fire control unit 102. Each of the cables 106 is a high-power cable, shielded to reduce or eliminate exposure to electromagnetic interference (EMI), electromagnetic pulse (EMP), or radio frequency (RF) interference within the cable 106. If the cable were not shielded, these sources of interference could potentially interfere with the operation of one or more of the pyrotechnic devices 100. The cables 106 used are typically at least as large as 18 gauge, because the cables 106 typically have to carry large transient currents of one to five amperes or more during firing. In the aggregate, the large number of high-power shielded cables 106 required for the branching configuration of the prior art are heavy and occupy significant volume, resulting in weight and packaging difficulties within an aircraft, spacecraft, missile, launch vehicle or other application where weight and space are at a premium. Further, in current systems, each fire control unit 102 can typically only support a relatively small number of pyrotechnic devices 100. Thus, multiple fire control units 102 may be required, further increasing the weight and volume of the overall pyrotechnic system 108.

Pyrotechnic systems used in aerospace systems also typically require a separate ordnance system battery 112 and power circuit, independent from the vehicle avionics batteries 110. This separate power system is required because surge currents occur in the power cabling when a pyrotechnic device is fired, potentially interfering with the avionics system. One or more separate ordnance system batteries 112 typically are used for firing. Due to the high delivery current required, the ordnance system batteries 112 are typically large and heavy. Thus, a separate ordnance system battery 112 and its attendant cabling add still more weight to a complex pyrotechnic system in an aerospace vehicle.

BRIEF SUMMARY OF THE INVENTION

The networked electronic ordnance system of the present invention connects a number of pyrotechnic devices to a bus controller using lighter and less voluminous cabling, in a more efficient network architecture, than previously possible. Each pyrotechnic device contains an initiator, which includes a pyrotechnic assembly and an electronics assembly. Certain pyrotechnic devices operating an energy level different from the network energy level include a smart connector for translating from the network energy level to the energy level of the pyrotechnic device.

Certain embodiments of a networked electronic ordnance system for controlling a variety of pyrotechnic devices at different energy levels include a bus controller controlling at least one pyrotechnic device operating at a first energy level and a smart connector adapting at least one pyrotechnic device operating at a second energy level to control by the bus controller. The smart connector may also include a plurality of capacitors for firing the at least one pyrotechnic device at the second energy level. In an embodiment, at least one pyrotechnic device operating at a first energy level and at least one pyrotechnic device operating at a second level include a logic device having a unique identifier. The smart connector may also include an energy reserve capacitor and an emitter follower circuit electrically connected to a logic device. Additionally, the smart connector may be connected to an initiator for firing the at least one pyrotechnic device at the second energy level. The smart connector may also include electrostatic discharge protection.

Certain embodiments of adaptive or smart connector include a bus connection allowing transfer of data with an ordnance network, a logic device for interpreting data received from the ordnance network via the bus connection, a capacitor bank for storing activation energy for an ordnance device, and an output drive for transmitting the activation energy to the ordnance device. In an embodiment, the logic device is implemented as an application specific integrated circuit (ASIC). In an embodiment, the capacitor bank further comprises an energy reserve capacitor and an emitter follower circuit. In an embodiment, the output drive includes an opto-coupler. In an embodiment, the bus connector includes electrostatic discharge protection. The smart connector may also include a housing and/or a circuit board for connecting the bus connection, the logic device, the capacitor bank, and the output drive.

In an embodiment, one or more pyrotechnic devices each contain a logic device that controls the functioning of the initiator. Each logic device has a unique identifier, which may be pre-programmed, or assigned when the networked electronic ordnance system is powered up. In another embodiment, two or more pyrotechnic devices are networked together with a bus controller. The network connections may be accomplished serially, in parallel, or a combination of the two. Thin, low-power cabling is used to connect the pyrotechnic devices to the bus controller. The cabling, when coupled with the bus controller, is substantially insensitive to EMI, EMP and RF signals in the ambient environment, and weigh less than the high-power shielded cables used in the prior art.

In another embodiment, both digital and analog fire control conditions are met before a pyrotechnic device can be fired. In an embodiment, each pyrotechnic device includes an energy reserve capacitor (ERC) which stores firing energy upon arming. By storing firing energy within each pyrotechnic device, surge currents in the network are reduced or eliminated, thereby eliminating the need for separate ordnance system batteries or power circuits. In an embodiment, a plurality of initiators are packaged together on a single substrate and networked together via that substrate.

DETAILED DESCRIPTION OF THE INVENTION

Figure 1:
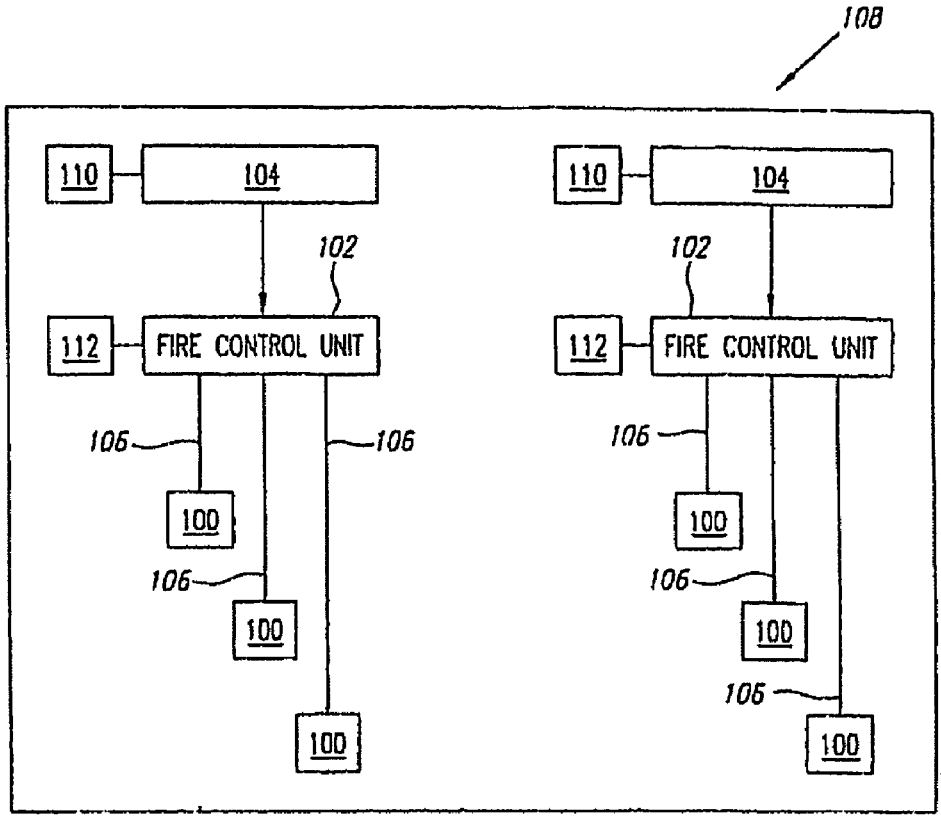
FIG. 1 (PRIOR ART)
FIG. 1 is a schematic view of a prior art pyrotechnic system.
Figure 2:
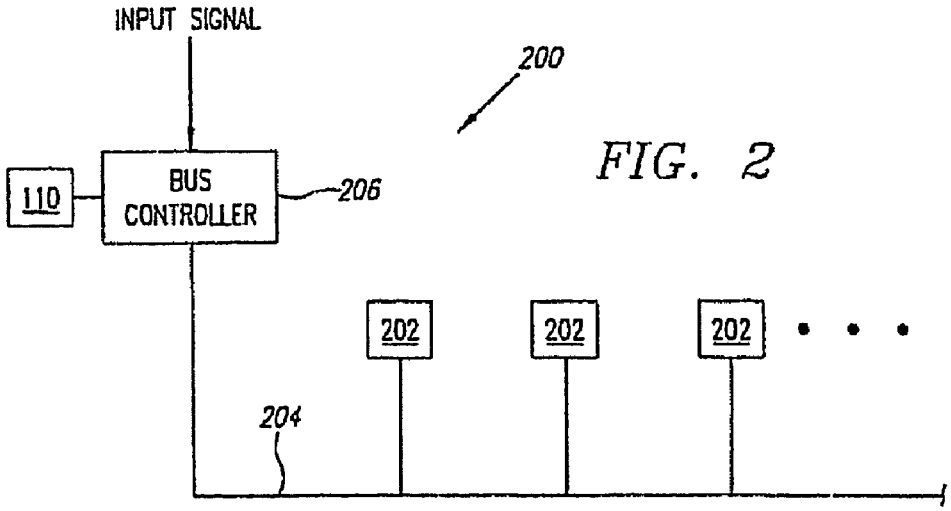
FIG. 2 is a schematic view of a networked electronic ordnance system.

Referring to FIG. 2, a preferred embodiment of a networked electronic ordnance system 200 is shown. The networked electronic ordnance system 200 includes a number of pyrotechnic devices 202 interconnected by a cable network 204, which may be referred to as a bus. The cable network 204 also connects the pyrotechnic devices 202 to a bus controller 206. In a preferred embodiment, the cable network 204 is formed from at least one two-wire cable which provides low voltage and low current power, and control signals, to the pyrotechnic devices 202. As used in this document, the word "cable" may refer to multiple strands of associated wire, a single wire, or other appropriate conductors, such as flexible circuit boards. Electric power transmission and signal transmission preferably both occur over the same cable in the cable network 204, thereby eliminating any need to provide separate power and signal cables. In a preferred embodiment, the cable network 204 is built from twisted shielded pair cable as small as 28 gauge. Such twisted shielded pair cable is known to those skilled in the art. However, the cables may be flat ribbon cable, or another type of cable capable of carrying low voltage and current power and signals, if desired. Further, the cable network 204 may be constructed from cables having other gauges, depending on the application in which the cable network 204 is used. The specific type of cable used, and its gauge, depends on weight, packaging and other constraints imposed by the application in which the networked electronic ordnance system 200 is used. The cable network 204 is preferably built with shielded cable. The cable network 204 preferably carries both digital signals and power to and from the bus controller 206. The cable network 204 preferably distributes electric power having a current on the order of magnitude of milliamperes. Because the cable network 204 distributes power and signals at low voltage and low current, flexible thin cables may be used, facilitating the integration of the networked electronic ordnance system 200 into an aircraft, missile, or other device.

In one embodiment, the pyrotechnic devices 202 are connected in parallel by the cable network 204, as shown in FIG. 2, or by other parallel connection strategies. Parallel connection provides an added level of reliability to the networked electronic ordnance system 200. However, the pyrotechnic devices 202 may be connected serially by the cable network 204. Serial connection may be advantageous in applications where packaging, weight and/or simplicity concerns are particularly important. The serial connection may be accomplished by connecting each of the pyrotechnic devices 202 to a single serial bus, by daisy-chaining the pyrotechnic devices together, or by other serial connection strategies.

The bus controller 206 preferably performs testing upon, and controls the arming and firing of, pyrotechnic devices 202 via the network 204. Preferably, the bus controller 206 includes or consists of a logic device programmed with instructions for controlling the test and operation of the pyrotechnic devices 202 and cable network 204 attached to it. The bus controller 206 may be an ASIC, a microprocessor, a field-programmable gate array (FPGA), discrete logic, another type of logic device, or a combination thereof. Depending on the application in which the bus controller 206 is used, the bus controller 206 itself may be connected to a fire control system or information handling system associated with the vehicle or device in which the networked electronic ordnance system 200 is used. Alternately, the bus controller 206 may be incorporated into or otherwise combined with one or more processors or information handling systems in the vehicle or device in which the networked electronic ordnance system 200 is used. Further, the bus controller 206 may stand alone, and receive input signals from a human or mechanical source. The bus controller 206 preferably is electrically connected to an avionics battery 110, from which power is drawn.

Figure 3:
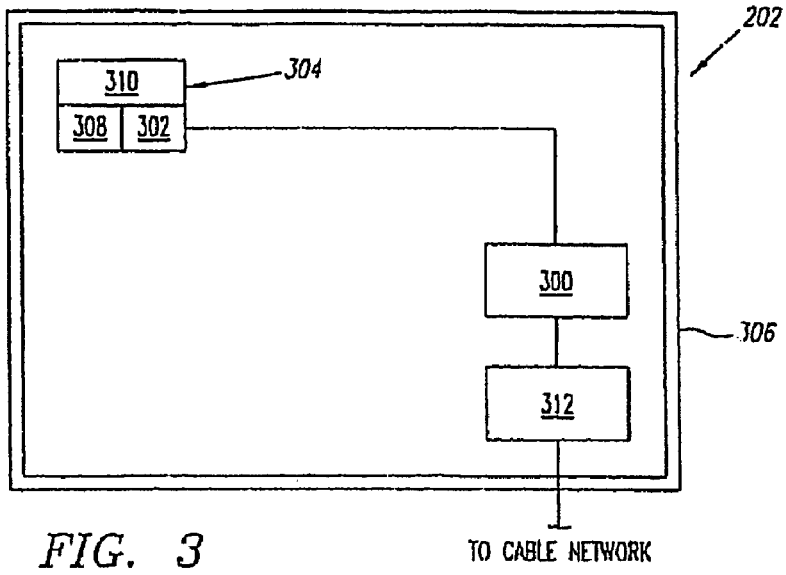
FIG. 3 is a schematic view of a pyrotechnic device for use in a networked electronic ordnance system.

In a preferred embodiment, each pyrotechnic device 202 may be any device capable of pyrotechnic initiation, such as but not limited to rocket motor igniters, thermal battery igniters, bolt cutters, cable cutters, and explosive bolts. The pyrotechnic devices 202 connected to a single bus controller 206 need not be of the same type, but rather may be different types of pyrotechnic devices 202 interconnected via the cable network 204. For example, an explosive bolt and a cable cutter may be connected together via the same cable network 204. Referring also to FIG. 3, a pyrotechnic device 202 has several subcomponents. A bus interface 312 is preferably included in the pyrotechnic device 202. The bus interface 312 is an electronic component that preferably accepts signals from the cable network 204 before those signals are passed further into the pyrotechnic device 202. Bus interfaces are well known to those skilled in the art. The pyrotechnic device 202 includes a logic device 300 electrically connected to the bus interface 312. If the bus interface 312 is not used, then the logic device 300 is preferably connected directly to the cable network 204. An initiator 304 within the pyrotechnic device 202 preferably includes an electronic assembly 308 and a pyrotechnic assembly 310. The pyrotechnic assembly 310 contains pyrotechnic material, and the electronic assembly 308 receives firing energy and directs it to the pyrotechnic assembly 310 for firing. The electronic assembly 308 preferably includes an energy reserve capacitor (ERC) 302. As used in the document, the term "initiator" refers to the combination of a pyrotechnic assembly 310 and an electronic assembly 308 within a pyrotechnic device 202. Thus, a pyrotechnic device 202 such as a bolt cutter or cable cutter will include an initiator 304 that, upon firing, exerts force on one or more components of the pyrotechnic device 202 to produce a bolt-cutting or cable-cutting action.

The ERC 302 is preferably included within the electronic assembly 308. However, the ERC 302 may be located elsewhere in the pyrotechnic device 202 if desired. By way of example and not limitation, the ERC 302 may be located adjacent to the electronic assembly 308, or within the logic device 300. Further, more than one energy reserve capacitor 302 may be provided within the electronic assembly 308 or within a single pyrotechnic device 202. Upon receipt of an arming command, the ERC 302 begins to charge, using power from the cable network 204. In a preferred embodiment, the ERC 302 has a capacitance of two microfarads, and is capable of charging in five milliseconds or less. However, the ERC 302 may have a larger or smaller capacitance, or a larger or smaller charging time, based on the particular application of the pyrotechnic device 202 and the type of initiator 304 used.

The type of initiator 304 used will vary depending on the application for which the networked electronic ordnance system 200 is used. In a preferred embodiment, a thin film bridge initiator 304 is placed directly on a substrate onto which the logic device 300 is mounted. Thin film bridge initiators are presently well known to those skilled in the art. In a preferred embodiment, the substrate is flexible and composed at least partly of KAPTON® brand polyamide film produced by DuPont Corporation. However, other insulative materials may be used for the substrate. In a preferred embodiment, circuit traces on the substrate connect the logic device 300 to the initiator 304. By using circuit traces to connect the logic device 300 to the initiator 304, the need for wire bonding to the thin film bridge initiator 304 is eliminated, simplifying packaging and increasing reliability. However, wire bonding or other types of connection may be used to connect the logic device 300 to the thin film bridge initiator 304, if desired. If desired, multiple initiators 304 may be combined on a single substrate, which may be advantageous in applications where two or more initiators 304 are located in close proximity to one another. The pyrotechnic device 202 need not utilize a substrate at all, and indeed may advantageously omit the substrate if some other types of initiator 304 are used. Further, the initiator 304 need not be a thin film bridge initiator, and may be any other type of initiator 304, such as but not limited to a traditional initiator in which a bridge wire passes through a pyrotechnic material, or a semiconductor bridge where a thin bridge connects two larger lands.

The logic device 300 within each pyrotechnic device 202 is preferably an application-specific integrated circuit (ASIC). However, the logic device 300 may be any other appropriate logic device 300, such as but not limited to a microprocessor, a field-programmable gate array (FPGA), discrete logic, or a combination thereof. Each logic device 300 has a unique identifier. In a preferred embodiment, the unique identifier is a code that is stored as a data object within the logic device 300. Preferably, the unique identifier is permanently stored within the logic device 300 as a data object. However, a unique identifier may be assigned to each logic device 300 by the bus controller 206 each time the networked electronic ordnance system 200 is powered up, may be encoded permanently into the hardware of the logic device 300, or otherwise may be uniquely assigned to each logic device 300. The unique identifier is preferably digital, and may be encoded using any addressing scheme desired. By way of example and not limitation, the unique identifier may be defined as a single bit within a data word having at least as many bits as the number of pyrotechnic devices 202 in the networked electronic ordnance system 200. All bits in the word are set low except for one bit set high. The position of the high bit within the word serves to uniquely identify a single logic device 300. Other unique identifiers may be used, if desired, such as but not limited to numerical codes or alphanumeric strings.

A digital command signal is transmitted from the bus controller 206 to a specific logic device 300 by including an address field, frame or other signifier in the command signal identifying the specific logic device 300 to be addressed. By way of example and not limitation, referring back to the example above of a unique identifier, a command signal may include an address frame having the same number of bits as the identifier word. All bits in the address frame are set low, except for one bit set high. The position of the high bit within the address frame corresponds to the unique identifier of a single pyrotechnic device 202. Therefore, this exemplary command would be recognized by the logic device 300 having the corresponding unique identifier. As with the unique identifier, other addressing schemes may be used, if desired, as long as the addressing scheme chosen is compatible with the unique identifiers used.

The addressing scheme preferably may be extended to allow the bus controller 206 to address a group of pyrotechnic devices 202 at once, where that group ranges from two pyrotechnic devices 202 to all of the pyrotechnic devices 202. By way of example and not limitation, by setting more than one bit to high in the address frame, a group of pyrotechnic devices 202 may be fired, where the logic device 300 in each pyrotechnic device 202 in that group has a unique identifier corresponding to a bit set to high in the address frame. As another example, an address frame having all bits set low and no bits set to high may constitute an "all fire" signifier, where each and every logic device 300 is programmed to recognize a command associated with the all-fire signifier and fire its associated pyrotechnic device 202. Other group firing schemes and all fire signals may be used if desired.

The design and use of a logic device 300 are known to those skilled in the art. Among other functions, the logic device 300 is adapted to test, arm, disarm and fire the pyrotechnic device 202 when commanded by the bus controller 206, as described below. In a preferred embodiment, the logic device 300 is combined with other electronics in the pyrotechnic device 202 for power management, safety, and electrostatic discharge (ESD) protection; such electronics are known to those skilled in the art. Two or more separate logic devices 300 may be provided within a pyrotechnic device 202, if desired. If multiple logic devices 300 are used, then functionality may be divided among different logic devices 300, or may be duplicated in separate logic devices 300 for redundancy.

The number of pyrotechnic devices 202 which may be attached to a single bus controller 206 varies depending upon the number of unique identifiers available, the construction of the bus controller 206, the power capabilities of the cable network 204, the distance spanned by the cable network 204, and the environment in which the networked electronic ordnance system 200 is to be used. By way of example and not limitation, if the identification scheme is capable of generating sixteen unique identifiers, no more than sixteen pyrotechnic devices 202 are connected to a single bus controller 206, so that the bus controller 206 can uniquely address each of the pyrotechnic devices 202 connected to it.

In a preferred embodiment, each pyrotechnic device 202 includes a Faraday cage 306 to shield the logic device 300 and any other electronic components within, as well as the initiator 304. A Faraday cage 306 is a conductive shell around a volume which shields that volume from the effects of external electric fields and static charges. The construction and use or a Faraday cage 306 is known to those skilled in the art. By including a Faraday cage 306 around at least part of the pyrotechnic device 202, inadvertent ignition in a strong electromagnetic radiation environment may be prevented. However, the Faraday cage 306 may be omitted from one or more of the pyrotechnic devices 202, particularly in applications where the expected electromagnetic radiation environment is mild, or where the pyrotechnic device 202 is itself placed in a larger structure shielded by a Faraday cage or other shielding device.

In a preferred embodiment, the networked electronic ordnance system 200 does not require a separate power source, but rather shares the same power sources as the other electronic systems in the vehicle or system. Typically, an avionics battery (not shown) is provided for powering the avionics within an aerospace vehicle, and a networked electronic ordnance system 200 used in such an aerospace vehicle preferably draws power from that avionics battery. Because the activation energy for each pyrotechnic device 202 is stored in the ERC 302, minimal or no surge currents occur in the cable network 204 when a pyrotechnic device is fired. Thus, the networked electronic ordnance system 200 may operate without the need for a separate battery and power distribution network.

Figure 4:
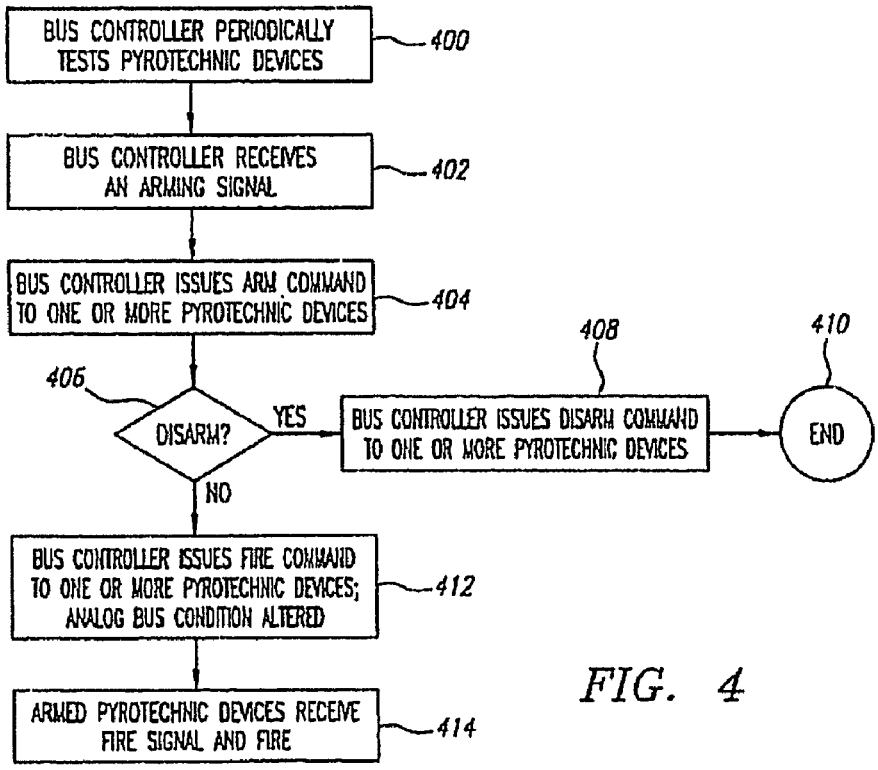
FIG. 4 is a flow chart illustrating the process by which the networked electronic ordnance system tests, arms and fires its pyrotechnic devices.

Referring also to FIG. 4, in step 400, in a preferred embodiment the bus controller 206 periodically queries each pyrotechnic device 202 to determine if the firing bridge in each pyrotechnic device 202 is intact. The frequency of such periodic queries depends upon the specific application in which the networked electronic ordnance system 200 is used. For example, the bus controller 206 may query each pyrotechnic device 202 every few milliseconds in a missile application where the missile is en route to a target, or every hour in a missile application where the missile is attached to the wing of an aircraft. Preferably, the bus controller 206 performs this query by transmitting a device test command to each pyrotechnic device 202. In a preferred embodiment, the device test signal consists of a test command and an address frame. The address frame is as described above, and allows a device test command to be transmitted to one or more specific pyrotechnic devices 202. Thus, each logic device 300 to which the test signal is addressed receives the test signal, recognizes the address frame and test command, and performs the requested test. After the test is performed in a pyrotechnic device 202, the logic device 300 in that pyrotechnic device 202 preferably responds to the bus controller 206 by transmitting test results over the network 204. The bus controller 206 may then report test results in turn to a central vehicle control processor (not shown) or may simply record that data internally or display it in some manner to an operator or user of the networked electronic ordnance system 200.

Preferably, one test that is performed is a test of the integrity of the firing element within each initiator 304. The firing element is the bridge, wire, or other structure in contact with the pyrotechnic material in the pyrotechnic assembly 310. Determining whether the firing element is intact in each initiator 304 is important to verifying the continuing operability of the networked electronic ordnance system 200. Further, by determining which specific firing element or elements have failed in a pyrotechnic system, repair of the pyrotechnic devices 202 having initiators 304 with such damaged firing elements is facilitated. The bus controller 206 issues a test signal to one or more specific pyrotechnic devices 202, where that test signal instructs each receiving pyrotechnic device 202 to test the integrity of the firing element. The logic device 300 within each pyrotechnic device to which the test signal is addressed receives the test signal, recognizes the address frame and test command, and tests the integrity of the firing element. In a preferred embodiment, the integrity of the firing element is tested by passing a very small controlled current through it. After the test is performed in a pyrotechnic device 202, the logic device 300 in that pyrotechnic device 202 responds to the bus controller 206 by transmitting test results over the network 204. In a preferred embodiment, the possible outcomes of the test are resistance too high, resistance too low, and resistance in range. If the resistance is too high, the bus controller 206 infers that the firing element is broken such that current will not flow through it easily, if at all. If the resistance is too low, the bus controller 206 infers that the firing element has shorted out. If the resistance is in range, the bus controller 206 infers that the firing element is intact. The bus controller 206 may then report test results in turn to a central vehicle control processor (not shown) or may simply record that data internally or display it in some manner to an operator or user of the networked electronic ordnance system 200.

Another built-in test function which is preferably performed by the bus controller 206 is determination of the status of the network 204. In a preferred embodiment, network status is determined by sending a signal over the network 204 to one or more of the pyrotechnic devices 202, which then echo the command back to the bus controller 206 or transmit a response back to the bus controller 206. That is, the bus controller 206 may ping one or more of the pyrotechnic devices 202. If the bus controller 206 receives the expected response within the expected time, it may be inferred that the network 204 is operational and that normal conditions exist across the network 204. If such response is not received, it may be inferred that either the pyrotechnic device 202 which was pinged is not functioning properly or that abnormal conditions exist on the network 204. The bus controller 206 may also sense current drawn by the bus, or bus voltage, to determine if bus integrity has been compromised. Other methods of testing the status of the network 204 are known to those skilled in the art.

When it is desired to arm one or more pyrotechnic devices 202 for later firing, the process moves to step 402, in which the bus controller 206 receives an arming signal. In a preferred embodiment, the arming signal comes from a separate processor located within the vehicle or other device utilizing the networked electronic ordnance system 200. For example, a vehicle control processor within a missile may transmit the arming signal to the bus controller 206. However, the bus controller 206 may itself generate the arming signal, if desired. The bus controller 206 may do so in response to a signal received from outside the bus controller 206 or may generate this signal based on an input from a user such as the detection of a button being pressed. Such a scheme may be useful in situations where human input is desirable as a step in ensuring the safety of the operation of the networked electronic ordnance system 200. For example, where the pyrotechnic devices 202 are located within a crewed vehicle, such as an aircraft or space craft, the use of manual human input to initiate arming may be desirable to ensure that the system is not inadvertently armed by automatic means.

Next, in step 404, the bus controller 206 issues an arming command to one or more pyrotechnic devices 202. In a preferred embodiment, the arming signal consists of an arm command and an address frame. The address frame is as described above, and allows an arm command to be transmitted to one or more specific pyrotechnic devices 202. Each logic device 300 to which the arm signal is addressed receives the arm signal, and recognizes the address frame and arm command. The arm command causes each addressed pyrotechnic device 202 to charge its ERC 302. The ERC 302 draws power from the cable network 204 for charging. As described above, the cable network 204 preferably carries electric power having a current in the milliampere range. In a preferred embodiment, the arming process is not instantaneous due to electric current limitations over the network 204 and the physical properties of the ERC 302. That is, it takes a finite amount of time for power to be transmitted over the network 204 and for the energy reserve capacitors 302 to charge utilizing that power. In a preferred embodiment, the ERC 302 takes substantially five milliseconds to charge completely. Thus, the arm command is preferably issued in advance of a fire command to allow the ERC 302 of each selected pyrotechnic device 202 to charge properly. After the arming command has been acted upon in a pyrotechnic device 202, the logic device 300 in each armed pyrotechnic device 202 preferably responds to the bus controller 206 by transmitting its armed status over the network 204. The bus controller 206 may then report the armed status of those pyrotechnic devices in turn to a central vehicle control processor (not shown) or may simply record that data internally or display it in some manner to an operator or user of the networked electronic ordnance system 200.

In step 406, after one or more pyrotechnic devices 202 have been armed, it is possible to disarm one or more of those armed pyrotechnic devices 202. Disarming is desirable in situations where the circumstances that necessitated arming the pyrotechnic devices 202 no longer exist. The determination of whether or not to disarm one or more of the armed pyrotechnic devices 202 may come from a source outside the bus controller 206, such as a signal from an external processor or a manual input such as a press of a button or the term of a key by a human operator. It is also possible that the disarming signal is generated by the bus controller 206 itself, which may be constructed to monitor circumstances and then determine whether to issue a disarming command.

If it is desired to disarm one or more of the armed pyrotechnic devices 202, the process moves from step 406 to step 408. The bus controller 206 issues a disarm command to one or more of the pyrotechnic devices 202. In a preferred embodiment, the disarming signal consists of a disarm command and an address frame. The address frame is as described above, and allows an arm command to be transmitted to one or more specific pyrotechnic devices 202. Each logic device 300 to which the arm signal is addressed receives the arm signal and recognizes the address frame and disarm command. The disarm command causes each selected pyrotechnic device 202 to discharge its ERC 302. A bleed resistor (not shown) is preferably connected across ERC 302, and the ERC 302 discharges its energy into that bleed resistor during the disarming process. A switched discharge device other than a bleed resistor may be used, if desired. The use of a bleed resistor or other switched discharge device to dissipate energy stored within a capacitor is well known to those skilled in the art. After the disarming command has been acted upon in a pyrotechnic device 202, the logic device 300 in each disarmed pyrotechnic device 202 preferably responds to the bus controller 206 by transmitting its disarmed status over the network 204. The bus controller 206 may then report the disarmed status of those pyrotechnic devices in turn to a central vehicle control processor (not shown) or may simply record that data internally or display it in some manner to an operator or user of the networked electronic ordnance system 200. The process then ends in step 410. The networked electronic ordnance system 200 is then capable of being rearmed at a later time if so desired. If so, the process begins again at step 402 as discussed above.

If it is not desired to disarm the armed pyrotechnic devices 202 in step 406, the process proceeds to step 412. In a preferred embodiment, for an armed pyrotechnic device to fire, it must receive a digital firing command and sense proper analog conditions on the cable network 204. That is, both digital and analog fire control conditions must be met before a pyrotechnic device can be fired. Data and power are both transmitted over the cable network 204. In step 412, at or shortly before transmitting a firing signal to one or more armed pyrotechnic devices 202, the analog condition of the bus is altered to a firing condition. Preferably, the bus controller 206 alters the analog condition of the cable network 204 to a firing condition. However, other devices electrically connected to the pyrotechnic system 200 may be used to alter the analog condition of the cable network 204 to a firing condition. The analog condition of the cable network 204 is preferably a characteristic of the electrical power transmitted across that cable network 204. By way of example and not limitation, the analog condition of the cable network 204 may be voltage level on the cable network 204, modulation depth, or frequency. However, other analog conditions may be used if desired. Preferably, the bus interface 312 senses the analog condition of the cable network 312.

The bus controller 206 then issues a firing signal to one or more of the armed pyrotechnic devices 202. The firing signal may be issued at some time after the arming command, because the arming command places one or more of the pyrotechnic devices 202 in a state of readiness for firing. As a safety measure, the pyrotechnic devices 202 are preferably not armed until soon before the time at which they are to be fired. However, depending on the application in which the pyrotechnic devices are used, the pyrotechnic devices 202 may remain armed indefinitely if so required. In a preferred embodiment, the firing signal consists of a fire command and an address frame. The address frame is as described above, and allows a fire command to be transmitted to one or more specific armed pyrotechnic devices 202.

In step 414, each logic device 300 to which the fire signal is addressed receives the fire signal and recognizes the address frame and fire command. When a particular logic device 300 receives the firing signal, it communicates with the bus interface 312 to determine whether the bus interface 312 senses the analog condition corresponding to the firing command. By requiring the pyrotechnic device 202 to sense both a digital firing signal and a corresponding analog bus condition before firing the initiator 304, safety is enhanced. For example, if the logic device 300 erroneously reads a digital firing signal at a time when the pyrotechnic device 202 is not armed, it cannot fire the initiator 304, because the analog bus condition will not correspond to the condition required for firing.

If the bus interface 312 senses the analog condition corresponding to the firing command, preferably the logic device 300 then operates the initiator 304. The logic device 300 closes a circuit between the ERC 302 and the initiator 304. The ERC 302 then releases its charge into the initiator 304, firing the initiator 304 as requested. In a preferred embodiment, the logic device 300 is destroyed or damaged when the initiator 304 is fired. However, the logic device 300 may be separated far enough from the initiator 304 such that the logic device 300 can transmit a signal confirming to the bus controller 206 the fired status of that pyrotechnic device 202 after firing.

In a preferred embodiment, signals traveling along the cable network 204 are multiplexed to enable a number of different signals to travel through the same cable at the same time. Multiplexing two or more electronic signals over a single cable to reduce the number of cables required for signal transmission is well known to those skilled in the art. The bus controller 206 multiplexes signals transmitted from the bus controller 206 to the pyrotechnic devices 202, and demultiplexes signals received at the bus controller 206 from the pyrotechnic devices 202. Each pyrotechnic device 202 preferably transmits signals to the bus controller 206 on a separate frequency or with another separate property such that those signals may travel together over the cable network 204 to the bus controller 206. The transmission of signals from a pyrotechnic device 202 is preferably controlled by the logic device 300 within that pyrotechnic device. However, if desired, signals transmitted to or from the bus controller 206, or both, are not multiplexed, and are instead transmitted in another manner that prevents interference between different signals on the cable network.

Figure 5:
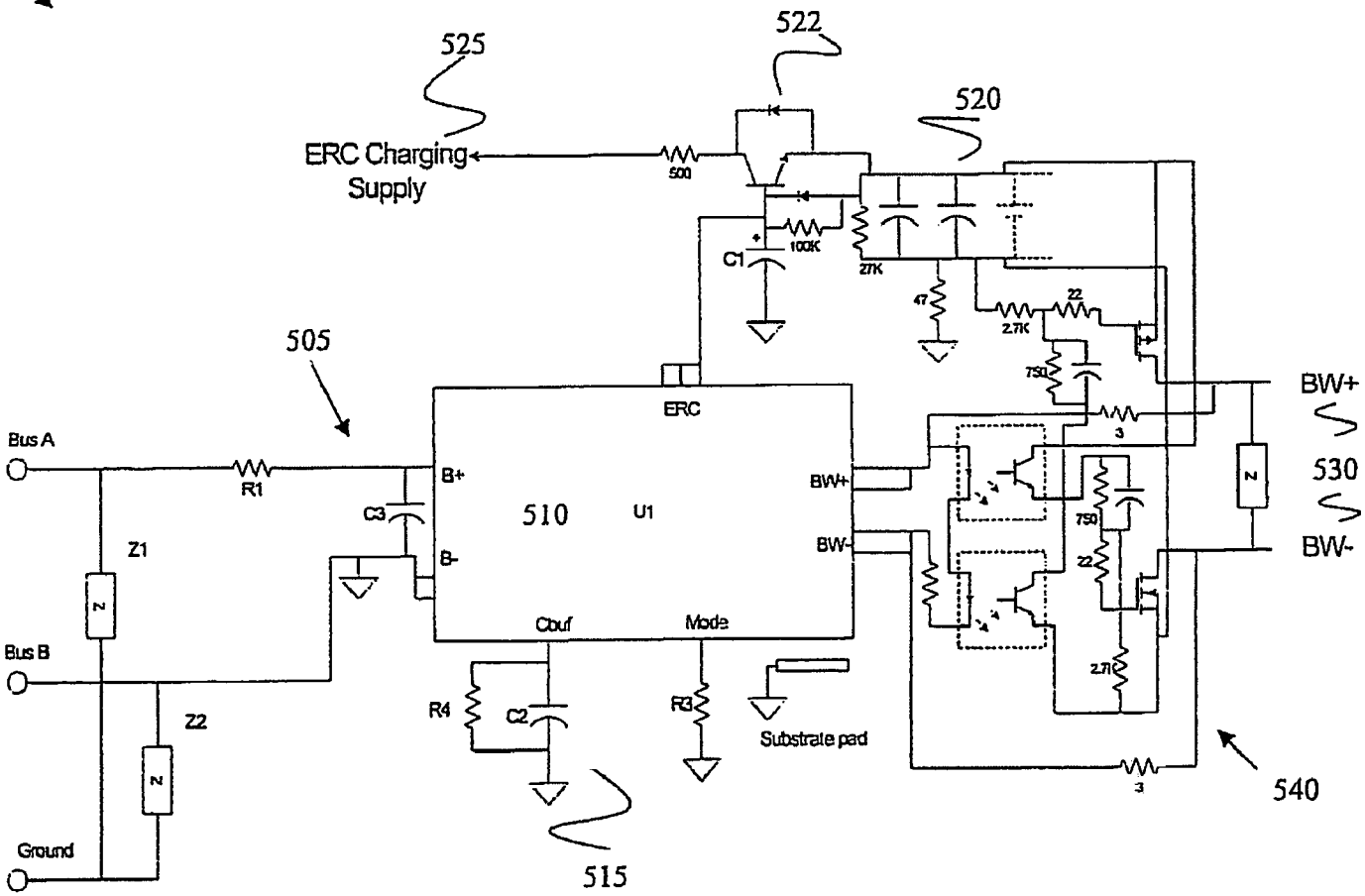
FIG. 5 illustrates a smart connector for use in a networked electronic ordnance system in accordance with an embodiment of the present invention.

FIG. 5 illustrates a smart connector 500 for use in a networked electronic ordnance system 200 in accordance with an embodiment of the present invention. In an embodiment, one or more smart connectors 500 are connected to the cable network 204. The smart connector 500 communicates with the bus controller 206 to control firing and other operation of pyrotechnic devices or other ordinance. The smart connector 500 translates or converts queries, commands, and/or other information from the bus controller 206 or other processing system on the network 204. In an embodiment, the smart connector 500 includes a bus connection 505, a logic device 510, a power supply buffer 515, a bank of capacitors 520, an emitter follower circuit 522, an energy reserve capacitor charging supply 525, bridgewires 530, and an opto-coupler 540.

The bus connection 505 allows a connection between the smart connector 500 at the network 204. The bus connection 505 includes electrostatic discharge (ESD) protection to safeguard the connector 500 as well as the network 204. The bus connection 505 allows commands and other information to pass between the logic device 510 and the bus controller 206.

The logic device 510 coordinates communications, such as firing instructions, between the bus controller 206 and ordnance initiator. The logic device 510 may be an ASIC or other processing circuit, for example. In an embodiment, the logic device 510 is similar to the logic device 300 described above. The logic device 510 draws power from the power supply buffer 515. The logic device 510 triggers the bank of firing capacitors 520 and resulting output through the opto-couplers 540 and bridgewires 530 upon command from the bus controller 206.

The bank of capacitors 520 provide energy for firing high energy ordnance. The bank 520 includes a plurality of capacitors, such as a bank of fifteen to twenty 47 μF capacitors. The bank of capacitors 520 is connected to the emitter follower circuit 522 to charge the firing capacitors. The emitter follower circuit 522, such as an NPN emitter follower, may be driven with lower power due to the high impedance in the circuit 522. The emitter follower 522 allows a larger firing capacitor to be used while preserving the charge sensing capability of the ASIC logic device 510. In an embodiment, the bank of firing capacitors 520 is not hard grounded in order to decouple noise in the firing circuit from other circuits in the system.

The bank of firing capacitors 520 is connected to the energy reserve capacitor (ERC) charging supply 525 (for example, a 25V high voltage power supply) to aid in firing high energy ordnance. The ERC 525 is connected to a voltage charging adapter and a charge sensing circuit. The emitter follower 522 allows the charging adapter and the charge sensor to function with the ERC 525 and the smart connector 500 circuitry when charging the capacitor bank 520 to the firing voltage (Verc-0.7V, for example).

Bridgewires 530 transmit firing or other control output from the logic device 510 to ordnance. The opto-coupler 530 drives output from the bridgewires 530 to ordnance initiator (s). Opto-couplers 530 may drive the output stage while preserving resistance-sensing and output stage fault-sensing of the logic device 510. In an embodiment, the bridgewires 530 and/or opto-couplers 530 include ESD protection. In another embodiment, Zener diodes may be used in place of opto-couplers 530 to separate an output drive from the logic device 510.

The smart connector 500 allows the bus controller 206 to control high energy ordnance via the network 204. Additionally, both low energy and high energy ordnance may be controlled and fired via the electronic ordnance system 200. Both the initiator 304 and the smart connector 500 interface with the bus or cable network 204 and allow the bus controller 206 to control firing and other operations for pyrotechnic devices or other ordnance. Circuitry in the smart connector 500 allows the bus controller 206 to fire and otherwise operate high energy ordnance. For example, circuitry in the smart connector 500 allows high energy ordnance to appear as low energy ordnance to the bus controller 206. Signals sent by the bus controller 206 to fire low energy ordnance, for example, are modified by the smart connector 500 to appear as high energy ordnance firing signals to high energy ordnance connected to the network 204. Thus, the controller 206 may communicate with the smart connector 500 and high energy ordnance using the same protocol(s) described above in relation to low energy ordnance via the network 204.

Figure 6A:
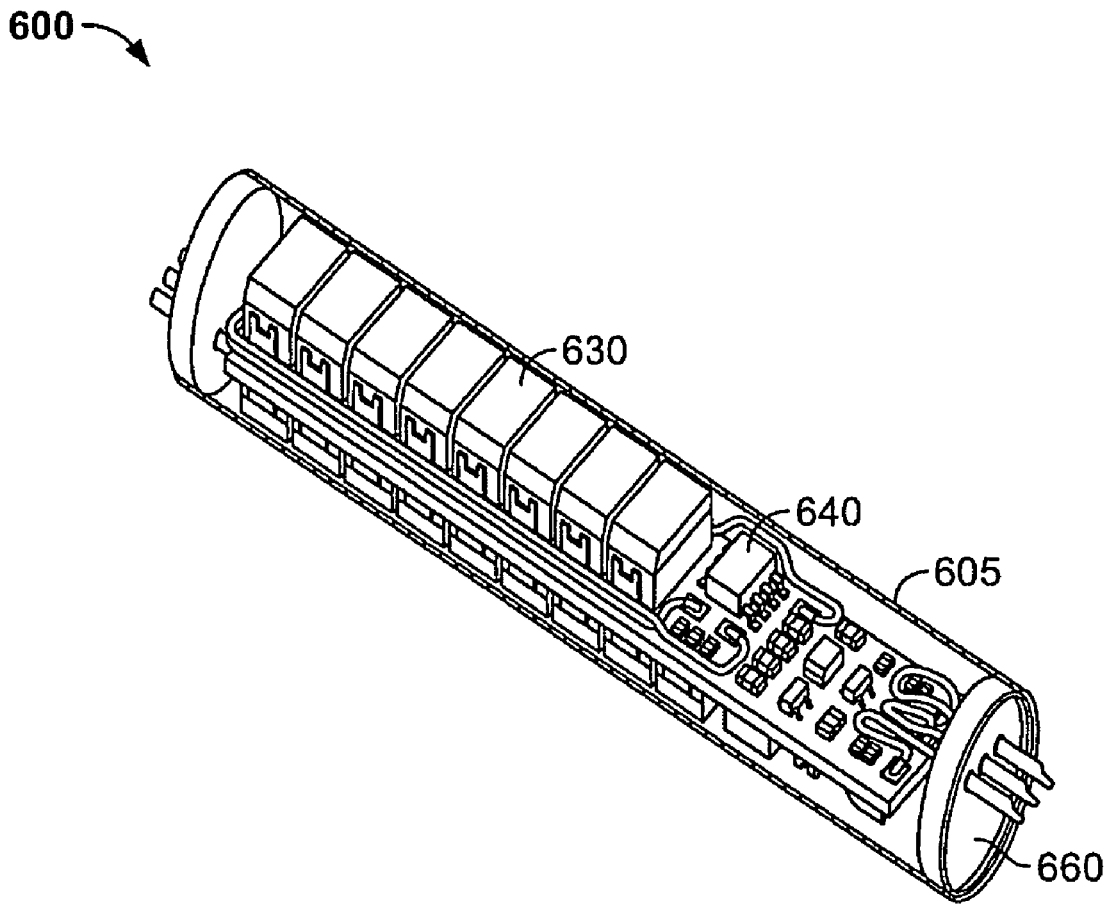
FIG. 6A illustrates a first view of a packaged smart connector for use in a networked electronic ordnance system in accordance with an embodiment of the present invention.
Figure 6B:
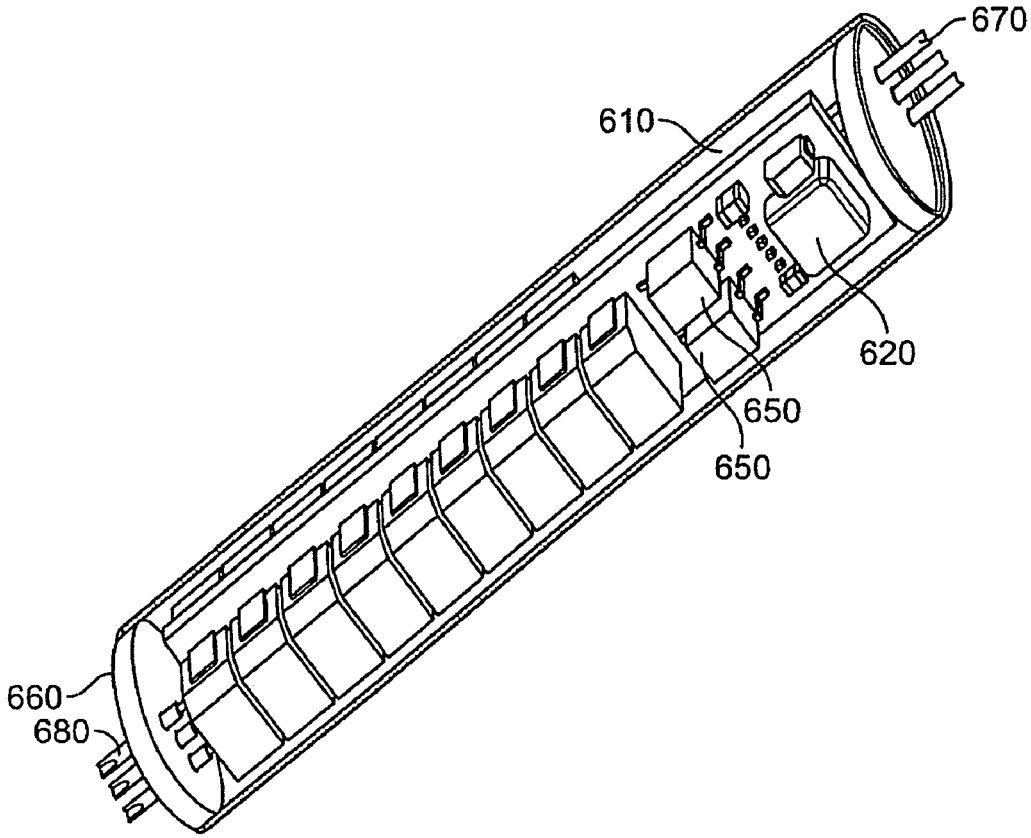
FIG. 6B illustrates a second view of a packaged smart connector for use in a networked electronic ordnance system in accordance with an embodiment of the present invention.

In an embodiment, the components of the smart connector 500 are integrated on a single circuit board. Alternatively, the components may be connected separately. FIGS. 6A and 6B show an example of a smart connector package.

FIG. 6A illustrates a first view of a packaged smart connector 600 for use in a networked electronic ordnance system 200 in accordance with an embodiment of the present invention. FIG. 6B illustrates a second view of the packaged smart connector 600 for use in a networked electronic ordnance system 200 in accordance with an embodiment of the present invention. The packaged smart connector 600 includes a housing 605, circuit board 610, logic device 620, capacitor bank 630, output transistors 640, opto-couplers 650, glass-to-metal seals 660, bus connector 670, and output connector 680.

In an embodiment, the packaged smart connector 600 is hermetically assembled with glass-to-metal seals 660, for example. Atmosphere in the packaged connector 600 may be filled with dry nitrogen or other similar substance, for example, to protect the circuitry inside the package. The atmosphere is contained within the housing 605 by the seals 660. The housing 605 of the package 600 is made of stainless steel or similar sturdy and stable material, for example, and the interior circuit board 610 is constructed from a glass epoxy, non-woven aramid, or other circuit board material, for example.

The circuit board 610 positions and connects the logic device 620, capacitor bank 530, output transistors 640, and opto-couplers 650 to the bus connector 670 and output connector 680 within the housing 605. The packaged smart connector 600 functions substantially similar to the smart connector 500 described above.

The package 600 may be arranged in a long, thin package, as shown in FIGS. 6A and 6B, or in a shorter, wider package, for example. The bus connector 670 connects the package 600 to the network 204. The output connector 680 connects the package 600 to an ordnance device or an initiator for an ordnance device. The packaged smart connector 600 may be integrated into a network ordnance system or may be substituted for another connector in an ordnance system, for example. In another embodiment, the packaged smart connector 600 may serve as a hotwire actuator or similar device to melt open a wire and release a stored substance, for example.

Figure 7:
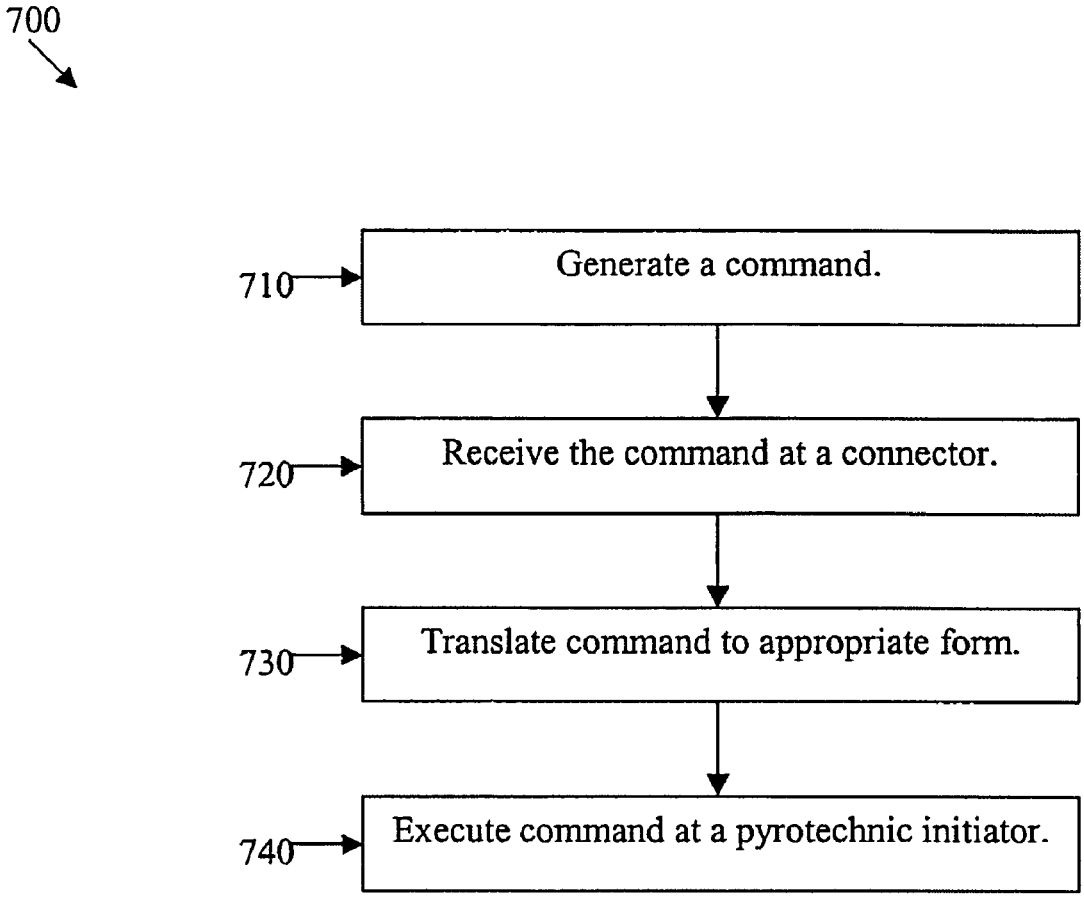
FIG. 7 illustrates a flow diagram for a method for interfacing multiple pyrotechnic devices on a common network in accordance with an embodiment of the present invention.

FIG. 7 illustrates a flow diagram for a method 700 for interfacing multiple pyrotechnic devices on a common network in accordance with an embodiment of the present invention. First, at step 710, a command is generated at a controller. For example, the bus controller 206 generates an arming command addressed to a high energy pyrotechnic device via a low energy network 204. Then, at step 720, the command is received at a connector. Next, at step 730, the command is translated to an appropriate form for a pyrotechnic initiator connected to the connector. For example, the low energy network firing command is translated by the smart connector 500 for use by a high energy pyrotechnic initiator. Then, at step 740, the command is executed by the pyrotechnic initiator. For example, the bank of capacitors 520 is charged in response to the arming command. Upon receipt of a firing command, for example, the activation energy stored in the bank of capacitors 520 is released into an initiator for the high energy pyrotechnic device. Alternatively, when a disarming command is received, the activation energy in the bank of capacitors 520 is dissipated.

Thus, certain embodiments provide an adaptive connector allowing both low and high energy ordnance to be controlled via a network. Certain embodiments allow signals to and from a controller to be transmitted and interpreted according to a standard protocol.

A preferred networked electronic ordnance system and many of its attendant advantages has thus been disclosed. It will be apparent, however, that various changes may be made in the form, construction and arrangement of the parts without departing from the spirit and scope of the invention, the form hereinbefore described being merely a preferred or exemplary embodiment thereof. Therefore, the invention is not to be restricted or limited except in accordance with the following claims and their legal equivalents.

The invention claimed is:

1. A networked electronic ordnance system for controlling a variety of pyrotechnic devices at different energy levels, said system comprising:

a plurality of pyrotechnic devices connected by a network, said plurality of pyrotechnic devices comprising at least one pyrotechnic device operating at a first energy level and at least one pyrotechnic device operating at a second energy level, said second energy level being higher than said first energy level;

a bus controller connected to said plurality of pyrotechnic devices through said network, said bus controller being operative to transmit commands onto the network at the first energy level; and a smart connector interconnecting at least one pyrotechnic device operating at said second energy level to the network for control by said bus controller, said smart connector being responsive to control commands issued by said bus controller at said first energy level to store an activation energy at said second energy level and transmit said activation energy to said interconnected pyrotechnic device.

2. The system of claim 1, wherein said smart connector further comprises a plurality of capacitors for firing said at least one pyrotechnic device at said second energy level.

3. The system of claim 1, wherein said smart connector further comprises an energy reserve capacitor and an emitter follower circuit electrically connected to a logic device.

4. The system of claim 1, wherein said smart connector is connected to an initiator for firing said at least one pyrotechnic device at said second energy level.

5. The system of claim 1, wherein said smart connector further comprises electrostatic discharge protection.

6. The system of claim 1, further comprising a plurality of said smart connectors.

7. The system of claim 1, wherein said smart connector adapts a firing instruction from said bus controller for said at least one pyrotechnic device.

8. The system of claim 1, wherein said smart connector receives a disarming command and dissipates activation energy at said at least one pyrotechnic device in response to said disarming command.

9. The system of claim 1, wherein said smart connector includes a logic device for interpreting data received from said bus controller to operate at least one pyrotechnic device operating a said first energy level and at least one pyrotechnic device operating at said second energy level.

10. The system of claim 1, wherein said bus controller generates a command for firing a pyrotechnic device at a low energy level and said smart controller translates said command into a command for firing a pyrotechnic device at a high energy level.

11. A networked electronic ordnance system for controlling a variety of pyrotechnic devices at different energy levels, said system comprising:

a plurality of pyrotechnic devices connected by a network, said plurality of pyrotechnic devices comprising at least one pyrotechnic device operating at a first energy level and at least one pyrotechnic device operating at a second energy level, said second energy level being higher than said first energy level;

a bus controller connected to said plurality of pyrotechnic devices through said network, said bus controller being operative to transmit commands onto the network at the first energy level; and a smart connector interconnecting a pyrotechnic device operating at said second energy level to said network for control by said bus controller, said smart connector comprising a bus connection allowing transfer of data with an ordnance network, a logic device for interpreting data received from said ordnance network via said bus connection, a capacitor bank for storing activation energy for an ordnance device at said second energy level, and an output drive for transmitting said activation energy to said pyrotechnic device operating at said second energy level.

12. The system of claim 11, wherein said logic device comprises an application specific integrated circuit.

13. The system of claim 11, wherein said smart connector further comprises an energy reserve capacitor and an emitter follower circuit.

14. The system of claim 11, wherein said output drive further comprises an opto-coupler.

15. The system of claim 11, wherein said bus connector further comprises electrostatic discharge protection.

16. The system of claim 11, wherein said output drive further comprises electrostatic discharge protection.

17. The system of claim 11, wherein said smart connector further comprises a housing.

18. The system of claim 11, wherein said smart connector further comprises a circuit board for connecting said bus connection, said logic device, said capacitor bank, and said output drive.

* * * * *